United States Patent [19]

Sando et al.

[11] 4,404,699

[45] Sep. 20, 1983

[54] METHOD OF CONTINUOUSLY WET HEAT TREATING A CLOTH AT AN ELEVATED TEMPERATURE

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 294,389

[22] Filed: Aug. 19, 1981

[30] Foreign Application Priority Data

Sep. 16, 1980 [JP] Japan ..... 55-128397

[51] Int. Cl.[3] ..... D06B 3/12; D06B 23/00

[52] U.S. Cl. ..... 8/149.1; 68/5 E

[58] Field of Search ..... 8/149.1; 68/5 D, 5 E, 68/207; 118/65, 67, 68

[56] References Cited

U.S. PATENT DOCUMENTS 3,426,554 2/1969 Simons ..... 68/5 D X

FOREIGN PATENT DOCUMENTS 2030183 4/1980 United Kingdom ..... 68/5 E

*Primary Examiner*—Philip R. Coe

*Attorney, Agent, or Firm*—Toren, McGeady and Stanger

[57] ABSTRACT

A method of continuously wet heat treating a cloth at an elevated pressure in the steamer body of a high pressure steamer maintained at a high temperature and pressure steam with the steam body having a said mechanism, including heating a treating solution in a treating solution application tank provided outside of the steamer body with the use of steam exhausted out of the seal mechanism of the steamer body, soaking a cloth to be treated with the thus heated treating solution up to the core part thereof, drying the cloth soaked with the treating solution by evaporating water therefrom, and then wet heat treating the resultant cloth in the high pressure steamer. The method is particularly suitable for such treatment as pretreatment and dyeing treatment of a long knitted or woven cylindrical cloth.

3 Claims, 1 Drawing Figure

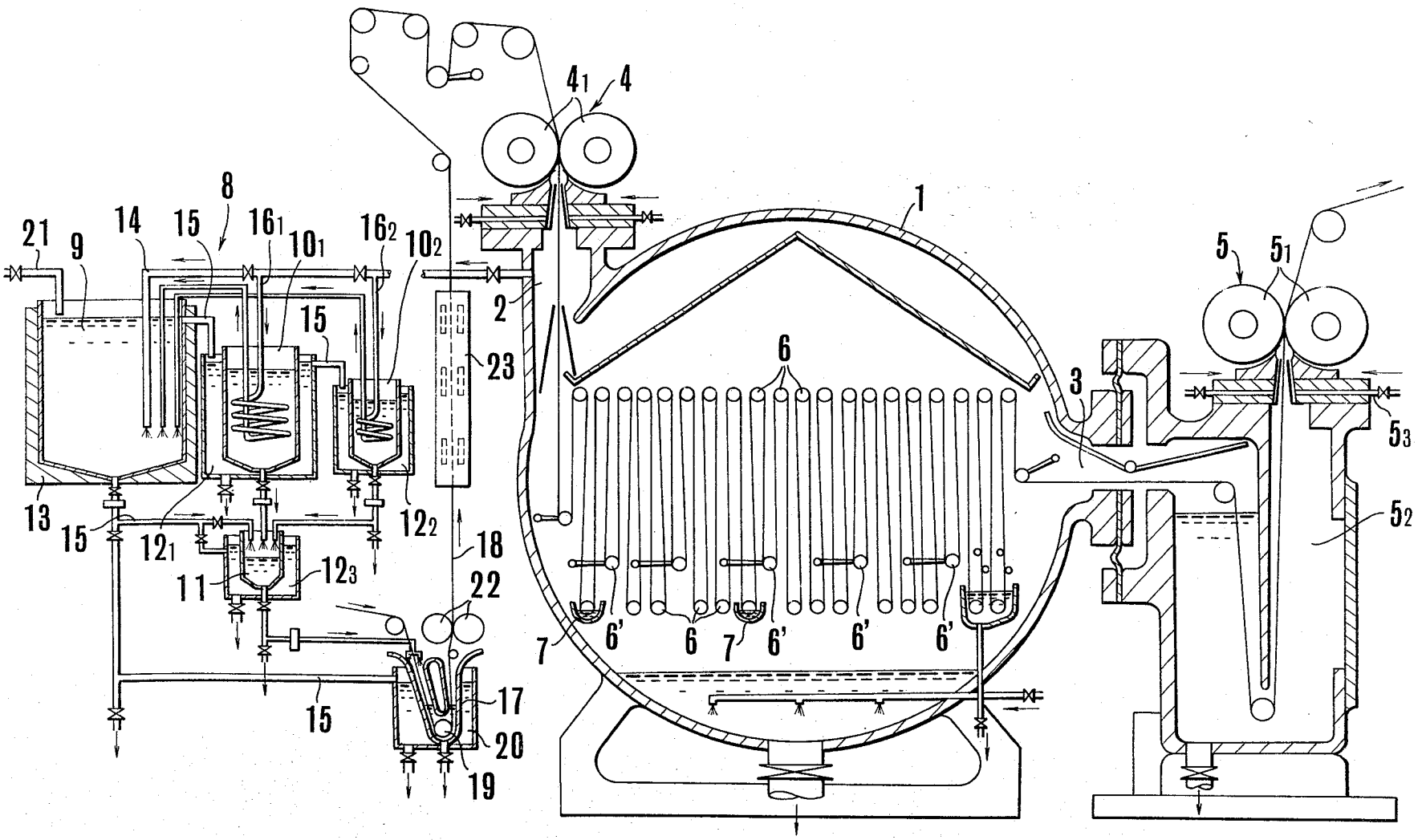
1
2
3
4
$4_1$
5
$5_1$
$5_2$
$5_3$
6
6'
7
8
9
$10_1$
$10_2$
11
$12_1$
$12_2$
$12_3$
13
14
15
$16_1$
$16_2$
17
18
19
20
21
22
23

METHOD OF CONTINUOUSLY WET HEAT TREATING A CLOTH AT AN ELEVATED TEMPERATURE

BACKGROUND OF THE INVENTION

The present invention relates to a method of continuously wet heat treating a long knitted or woven cloth, particularly a cylindrical one, with high temperature steam under pressure to pretreat or dye the cloth effectively.

For pretreating or dyeing a long knitted or woven cloth produced commercially, it has conventionally been done to soak the cloth with, for instance, a dye solution and to wet heat treat the resultant cloth in a steamer at a temperature lower than 100° C. in batches discontinuously. In the conventional method of dyeing a cloth, therefore, no continuous treatment can be done, not only consuming a large heat energy but also causing irregularity in the degree of dyeing from batch to batch, and, moreover, since it needs a long while until the dye is fixed firmly in the cloth in wet heat treating the cloth at a temperature below 100° C., such a process is obviously uneconomical.

After various studies of the present inventors over a long period for shortening the pretreating or dyeing time of a cloth, a high pressure steamer has been developed in which pretreatment or dyeing of the cloth can be done continuously in a short time of second level, and such a high pressure steamer is under practical operation. In this high pressure steamer, however, a pair of seal rolls pressed with each other is provided for supplying a cloth continuously into the steamer body while maintaining the interior of the steamer body with a wet heat under pressure, so that the cloth must be supplied in the steamer body through the seal rolls. In passing a cloth soaked with a treating solution outside of the steamer body through the seal rolls, the cloth is squeezed, causing a shortage in the amount of the treating solution in the wet heat treatment, particularly when the cloth is a cylindrical one.

Various methods and devices have been proposed by the present inventors to soak the cloth with a treating solution inside of a steamer body, but the interior of a steamer body is maintained usually with a wet heat at a temperature of about 150° C. and the temperature of the treating solution to be supplied in the steamer body is at the ordinary temperature (about 20° C.), having a tolerable temperature difference therebetween. In supplying a low temperature treating solution in a high temperature steamer body, the high temperature steam in the steamer body is condensed, not only lowering the humidity in the steamer body but also diluting the concentration of the treating solution being applied. Therefore, uniform treatment of a cloth, particularly a cylindrical one, can by no means be done continuously.

SUMMARY OF THE INVENTION

Under such circumstances, the object of the present invention is, in continuously wet heat treating a long cloth in a high pressure steamer, to soak the cloth to be treated with a prescribed treating solution outside of the steamer body, and another object of the invention is to elevate the soaking effect of the cloth by heating the treating solution to about 100° C.

The outline of the method comprises heating a treating solution in a treating solution tank provided outside of the steamer body with the use of steam exhausted out of the seal mechanism of the steamer body, soaking the cloth to be treated with the thus heated treating solution up to the core part thereof, drying the cloth soaked with the treating solution by evaporating water therefrom, and then wet heat treating the resultant cloth in the high pressure steamer.

The method is particularly suitable for the treatment of a long knitted or woven cylindrical cloth.

BRIEF DESCRIPTION OF THE DRAWING

The drawing is a sectional side view of an example of apparatus to be used for the continuous wet heat treatment of a cloth continuously in the present invention.

DETAILED DESCRIPTION OF THE PREFERRED EMBODIMENTS

Preferred embodiments of the present invention will be described in detail in the following by referring to the drawing.

In the drawing, 1 is a steamer body, 2 is a cloth inlet of the steamer body 1, and 3 is a cloth outlet thereof. The cloth inlet 2 and the cloth outlet 3 are provided respectively with an inlet side seal mechanism 4 and an outlet side seal mechanism 5 for allowing the continuous taking in and out of the cloth while maintaining the high temperature wet heat in the interior of the steamer body 1. The inlet side seal mechanism 4 comprises a pair of seal rubber rolls 4, pressed together. The outlet side seal mechanism 5 comprises similarly a pair of seal rubber rolls, pressed together a nearly J-shaped slow cooling tank $\mathbf{5_2}$ and a cooling water supply pipe $\mathbf{5_3}$ for supplying cooling water, which serves also for the washing of the treated cloth, from outside of the steamer body. 6 are a plurality of cloth guide rolls provided up and down zigzag horizontally in the steamer body, including tension control rolls 6' at proper positions. 7 are wetting water tanks attached to the lower side cloth guide rolls 6 at proper positions for wetting the cloth during wet heat treatment.

Now, 8 is a treating solution supply mechanism provided outside of the steamer body 1. The treating solution supply mechanism 8 comprises a hot water tank 9, one or more original treating solution tanks $\mathbf{10_1}$ and $\mathbf{10_2}$ (for instance, a dye solution tank $\mathbf{10_1}$ and an auxiliary agent tank $\mathbf{10_2}$), and a mixing tank 11 for mixing appropriate amounts of the original treating solutions supplied from the original treating solution tanks $\mathbf{10_1}$ and $\mathbf{10_2}$ by stirring. The original treating solution tanks $\mathbf{10_1}$ and $\mathbf{10_2}$ and the mixing tank 11 are placed respectively in lagging tanks $\mathbf{12_1}$, $\mathbf{12_2}$ and $\mathbf{12_3}$, and the hot water tank 9 is surrounded with an insulating material 13 for keeping the hot water tank 9 hot. 14 is a steam pipe for supplying hot steam exhausted from the cloth inlet 2 of the steamer body 1 into the hot water tank 9 for heating the water therein up to a temperature of nearly 100° C., and 15 are hot water supply pipes for supplying hot water from the hot water tank 9 respectively into the lagging tanks $\mathbf{12_1}$, $\mathbf{12_2}$ and $\mathbf{12_3}$. $\mathbf{16_1}$ and $\mathbf{16_2}$ are spiral pipes branched from the steam pipe 14 and provided respectively in the original treating solution tanks $\mathbf{10_1}$ and $\mathbf{10_2}$ for heating the orignal treating solutions therein.

17 is a treating solution apply tank for applying the mixed treating solution, coming from the mixing tank 11, to a cloth to be treated. The treating solution application tank 17 is provided with a cloth guide roll 19 for guiding the cloth and is surrounded with a lagging tank 20. 21 is a water supply pipe, 22 is a pair of squeeze rolls, and 23 is an infrared drier for removing water from the cloth soaked with the treating solution.

An embodiment of the present inventive method for the continuous wet heat treatment of a cloth by using the above-mentioned example of the apparatus is as follows.

The interior of the steamer body is maintained with high temperature and pressure steam, for instance at 160° C. and 5.5 kg/cm$^2$, and simultaneously water is supplied successively through the cooling water pipe $\mathbf{5}_3$ in the slow cooling tank $\mathbf{5}_2$ at the ordinary temperature. In beginning the operation, the waste steam in the steamer body 1 is supplied through the steam pipe into the hot water tank 9, and a part thereof is passed through the spiral pipes $\mathbf{16}_1$ and $\mathbf{16}_2$. Thus, water in the hot water tank 9 as well as the original treating solutions in the original solution tanks $\mathbf{10}_1$ and $\mathbf{10}_2$ are heated up to nearly 100° C. Appropriate amounts of the high temperature original treating solutions are mixed in the mixing tank 11, and the mixed treating solution, for instance a dye solution, is supplied successively also the treating solution application tank 17. Since the mixing tank 11 and the treating solution application tank 17 are surrounded with the lagging tanks $\mathbf{12}_3$ and 20 at a temperature as high as nearly 100° C., the dye solution in the treating solution application tank 17 is also at a temperature of nearly 100° C.

In continuously passing a cloth to be treated through the heated dye solution in the treating solution tank 17 continuously, the cloth is soaked with the dye solution effectively in a short time up to the core part thereof. The cloth soaked sufficiently with the dye solution is then passed continuously through the infrared drier 23 to remove water in the cloth, and is transferred into the steamer body 1 through the inlet side seal rubber rolls $\mathbf{4}_1$. Since the dye has been adhered firmly in the cloth up to the core part thereof in passing through the infrared drier 23, there is no danger that the dye is removed in passing the cloth through the seal rubber rolls $\mathbf{4}_1$ into the steamer body.

In the steamer body 1, the cloth is wet heat treated effectively for fixing the dye due to the effect of high temperature and pressure steam while supplying an appropriate moisture to the cloth by immersing the cloth occasionally in water in the wetting water tanks 7, and thus the cloth can be dyed uniformly and eminently. Pretreatment of a cloth such as scouring, bleaching and weight reduction can be done similarly to give an excellent result.

As above described in detail, in the present invention, the treating solution is heated outside of the steamer body by utilizing high temperature waste steam exhausted out of the steamer body, so that the heat energy for heating the treating solution can economically be spared. Since the treating solution has been heated up to a temperature nearly 100° C., the permeability of the treating solution in the cloth is excellent, and the cloth can be soaked therewith effectively in a short time up to the core part of the cloth, thus elevating the soaking efficiency. Furthermore, the cloth soaked sufficiently with the treating solution is dried with the use of the infrared drier for adhering the dye firmly in the cloth, so that there is no danger that the dye is removed in passing the cloth through the seal rubber rolls into the steamer body, and the cloth, containing a sufficient amount of the treating solution, can effectively and uniformly be wet heat treated in the steamer body. Thus, the treatment of a cloth, such as pretreatment and dyeing, can be done quite emimently.

In the present invention, moreover, since the original treating solution tanks, the mixing tank and the treating solution apply tank are surrounded with the lagging tanks to which hot water is supplied at a prescribed high temperature for maintaining the temperature of the treating solution constant, the present invention has an effect that the treatment of a cloth can be done at a constant temperature over all the four seasons of the year to give a uniform product.

What is claimed is:

1. A method of continuously treating a cloth comprising wet heat treating the cloth at an elevated pressure in a high pressure steamer containing a high temperature and pressure steam with the high pressure steamer comprising a steamer body with a seal mechanism, heating a treating solution in a treating solution application tank provided outside the steamer body by using steam exhausted out of the seal mechanism of the steamer body, soaking the cloth prior to being treated in the steamer up to the core part thereof with thus heated treating solution, and drying the cloth soaked with the treating solution by evaporating water therefrom prior to the cloth being treated in the steamer.

2. A method of continuously treating a cloth according to claim 1, in which the cloth to be treated is particularly a long knitted or woven cylindrical one.

3. A method of continuously treating a cloth according to claims 1 or 2, in which the drying of the cloth soaked with the treating solution is done with the use of an infrared drier.

* * * * *